US009275646B2

(12) United States Patent
Lang et al.

(10) Patent No.: US 9,275,646 B2
(45) Date of Patent: Mar. 1, 2016

(54) METHOD FOR INTER-CHANNEL DIFFERENCE ESTIMATION AND SPATIAL AUDIO CODING DEVICE

(71) Applicant: Huawei Technologies Co., Ltd., Shenzhen (CN)

(72) Inventors: Yue Lang, Munich (DE); David Virette, Munich (DE); Jianfeng Xu, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 45 days.

(21) Appl. No.: 14/145,432

(22) Filed: Dec. 31, 2013

(65) Prior Publication Data

US 2014/0164001 A1 Jun. 12, 2014

Related U.S. Application Data

(63) Continuation of application No. PCT/EP2012/056342, filed on Apr. 5, 2012.

(51) Int. Cl.
*G10L 19/00* (2013.01)
*G10L 21/00* (2013.01)
(Continued)

(52) U.S. Cl.
CPC ..... *G10L 19/008* (2013.01); *H04S 3/008* (2013.01); *H04S 2400/01* (2013.01); *H04S 2420/01* (2013.01); *H04S 2420/03* (2013.01)

(58) Field of Classification Search
USPC ..... 704/200–232, 500–504
See application file for complete search history.

(56) References Cited

U.S. PATENT DOCUMENTS 5,835,375 A * 11/1998 Kitamura ..... 700/94
5,974,380 A * 10/1999 Smyth et al. ..... 704/229
6,005,946 A * 12/1999 Varga et al. ..... 381/17
(Continued)

FOREIGN PATENT DOCUMENTS

CN 1647156 A 7/2005
CN 101408615 A 4/2009
(Continued)

OTHER PUBLICATIONS

Foreign Communication From a Counterpart Application, Chinese Application No. 201280023292.X, Chinese Office Action dated Oct. 10, 2014, 3 pages.
(Continued)

*Primary Examiner* — Jesse Pullias
(74) *Attorney, Agent, or Firm* — Conley Rose, P.C.; Grant Rodolph

(57) ABSTRACT

Methods and devices for a low complex inter-channel difference estimation are provided. A method for the estimation of inter-channel differences (ICDs), comprises applying a transformation from a time domain to a frequency domain to a plurality of audio channel signals, calculating a plurality of ICD values for the ICDs between at least one of the plurality of audio channel signals and a reference audio channel signal over a predetermined frequency range, each ICD value being calculated over a portion of the predetermined frequency range, calculating, for each of the plurality of ICD values, a weighted ICD value by multiplying each of the plurality of ICD values with a corresponding frequency-dependent weighting factor, and calculating an ICD range value for the predetermined frequency range by adding the plurality of weighted ICD values.

19 Claims, 3 Drawing Sheets

(51) Int. Cl.
*G10L 19/008* (2013.01)
*H04S 3/00* (2006.01)

(56) References Cited

U.S. PATENT DOCUMENTS

| | | | | |
|---|---|---|---|---|
| 6,199,039 | B1 * | 3/2001 | Chen et al. | 704/229 |
| 7,006,636 | B2 * | 2/2006 | Baumgarte et al. | 381/17 |
| 2005/0226426 | A1 | 10/2005 | Oomen et al. | |
| 2008/0002842 | A1 * | 1/2008 | Neusinger et al. | 381/119 |
| 2010/0121632 | A1 | 5/2010 | Chong | |
| 2011/0013790 | A1 * | 1/2011 | Hilpert et al. | 381/300 |
| 2011/0046964 | A1 | 2/2011 | Moon et al. | |
| 2012/0224702 | A1 | 9/2012 | Den et al. | |
| 2012/0259622 | A1 | 10/2012 | Liu et al. | |

FOREIGN PATENT DOCUMENTS

| | | | |
|---|---|---|---|
| JP | 2013511062 | A | 3/2013 |
| WO | 2008132850 | A1 | 11/2008 |
| WO | 2011072729 | A1 | 6/2011 |
| WO | 2011080916 | A1 | 7/2011 |

OTHER PUBLICATIONS

Foreign Communication From a Counterpart Application, Chinese Application No. 201280023292.X, Chinese Search Report dated Sep. 24, 2014, 2 pages.

Foreign Communication From a Counterpart Application, PCT Application No. PCT/EP2012/056342, International Search Report dated Jan. 2, 2013, 4 pages.

Foreign Communication From a Counterpart Application, PCT Application No. PCT/EP2012/056342, Written Opinion dated Jan. 2, 2013, 5 pages.

"Series G: Transmission Systems and Media Digital Systems and Networks, Digital Terminal Equipments—Coding of Voice and Audio Signal, Wideband Embedded Extension for ITU-T G.711 Pulse Code Modulation," ITU-T, Telecommunication Standardization Sector of ITU, G.711.1, Sep. 2012, 218 pages.

"Series G: Transmission Systems and Media, Digital Systems and Networks, Digital Terminal Equipments—Coding of Voice and Audio Signals, 7 kHz Audio-Coding within 64 kbit/s," ITU-T, Telecommunication Standardization Sector of ITU, G.722, Sep. 2012, 274 pages.

Breebaart, J., et al., "Parametric Coding of Stereo Audio," EURASIP Journal on Applied Signal Processing, Sep. 2005, 1305-1322.

Faller, C., et al., "Efficient Representation of Spatial Audio Using Perceptual Parametrization," Media Signal Processing Research, IEEE Workshop on Applications of Signal Processing to Audio and Acoustics, Oct. 21-24, 2001, pp. 199-202.

Partial English Translation and Abstract of Japanese Patent Application No. JP2013511062, Dec. 28, 2015, 89 pages.

Foreign Communication From A Counterpart Application, Japanese Application No. 2015-503767, Japanese Office Action dated Dec. 1 , 2015, 4 pages.

Foreign Communication From A Counterpart Application, Japanese Application No. 2015-503767, English Translation of Japanese Office Action dated Dec. 1, 2015, 6 pages.

* cited by examiner

METHOD FOR INTER-CHANNEL DIFFERENCE ESTIMATION AND SPATIAL AUDIO CODING DEVICE

CROSS-REFERENCE TO RELATED APPLICATIONS

This application is a continuation of International Application No. PCT/EP2012/056342, filed on Apr. 5 2012, which is hereby incorporated by reference in its entirety.

TECHNICAL FIELD

The present invention pertains to a method for inter-channel difference (ICD) estimation and a spatial audio coding or parametric multi-channel coding device, in particular for parametric multichannel audio encoding.

BACKGROUND

Parametric multi-channel audio coding is described in Faller, C., Baumgarte, F.: "Efficient representation of spatial audio using perceptual parametrization", Proc. IEEE Workshop on Appl. of Sig. Proc. to Audio and Acoust., October 2001, pp. 199-202. Downmixed audio signals may be upmixed to synthesize multi-channel audio signals, using spatial cues to generate more output audio channels than downmixed audio signals. Usually, the downmixed audio signals are generated by superposition of a plurality of audio channel signals of a multi-channel audio signal, for example a stereo audio signal. The downmixed audio signals are waveform coded and put into an audio bitstream together with auxiliary data relating to the spatial cues. The decoder uses the auxiliary data to synthesize the multi-channel audio signals based on the waveform coded audio channels.

There are several spatial cues or parameters that may be used for synthesizing multi-channel audio signals. First, the inter-channel level difference (ILD) indicates a difference between the levels of audio signals on two channels to be compared. Second, the inter-channel time difference (ITD) indicates the difference in arrival time of sound between the ears of a human listener. The ITD value is important for the localization of sound, as it provides a cue to identify the direction or angle of incidence of the sound source relative to the ears of the listener. Third, the inter-channel phase difference (IPD) specifies the relative phase difference between the two channels to be compared. A subband IPD value may be used as an estimate of the subband ITD value. Finally, inter-channel coherence (ICC) is defined as the normalized inter-channel cross-correlation after a phase alignment according to the ITD or IPD. The ICC value may be used to estimate the width of a sound source.

ILD, ITD, IPD and ICC are important parameters for spatial multi-channel coding/decoding, in particular for stereo audio signals and especially binaural audio signals. ITD may for example cover the range of audible delays between −1.5 milliseconds (ms) to 1.5 ms. IPD may cover the full range of phase differences between $-\pi$ and $\pi$. ICC may cover the range of correlation and may be specified in a percentage value between 0 and 1 or other correlation factors between −1 and +1. In current parametric stereo coding schemes, ILD, ITD, IPD and ICC are usually estimated in the frequency domain. For every subband, ILD, ITD, IPD and ICC are calculated, quantized, included in the parameter section of an audio bitstream and transmitted.

Due to restrictions in bitrates for parametric audio coding schemes there are sometimes not enough bits in the parameter section of the audio bitstream to transmit all of the values of the spatial coding parameters. For example, the document U.S. Patent Application Publication 2006/0153408 A1 discloses an audio encoder wherein combined cue codes are generated for a plurality of audio channels to be included as side information into a downmixed audio bitstream. The document U.S. Pat. No. 8,054,981 B2 discloses a method for spatial audio coding using a quantization rule associated with the relation of levels of an energy measure of an audio channel and the energy measure of a plurality of audio channels.

SUMMARY

An idea of the present invention is to calculate inter-channel difference (ICD) values for each frequency subband or frequency bin between each pair of a plurality of audio channel signals and to compute a weighted average value on the basis of the ICD values. Dependent on the weighting scheme, the perceptually important frequency subbands or bins are taken into account with a higher priority than the less important ones.

Advantageously, the energy or perceptual importance is taken into account with this technique, so that ambience sound or diffuse sound will not affect the ICD estimation. This is particularly advantageous for meaningfully representing the spatial image of sounds having a strong direct component such as speech audio data.

Moreover, the proposed method reduces the number of spatial coding parameters to be included into an audio bitstream, thereby reducing estimation complexity and transmission bitrate.

Consequently, a first aspect of the present invention relates to a method for the estimation of inter-channel differences, ICDs, the method comprising applying a transformation from a time domain to a frequency domain to a plurality of audio channel signals, calculating a plurality of ICD values for the ICD between at least one of the plurality of audio channel signals and a reference audio channel signal over a predetermined frequency range, each ICD value being calculated over a portion of the predetermined frequency range, calculating, for each of the plurality of ICD values, a weighted ICD value by multiplying each of the plurality of ICD values with a corresponding frequency-dependent weighting factor, and calculating an ICD range value for the predetermined frequency range by adding the plurality of weighted ICD values.

According to a first implementation of the first aspect the ICDs are IPDs or ITDs. These spatial coding parameters are particularly advantageous for audio data reproduction for human hearing.

According to a second implementation of the first aspect the transformation from a time domain to a frequency domain comprises one of the group of Fast Fourier Transformation (FFT), cosine modulated filter bank, Discrete Fourier Transformation (DFT) and complex filter bank.

According to a third implementation of the first aspect the predetermined frequency range comprises one of the group of a full frequency band of the plurality of audio channel signals, a predetermined frequency interval within the full frequency band of the plurality of audio channel signals, and a plurality of predetermined frequency intervals within the full frequency band of the plurality of audio channel signals.

According to a first implementation of the third implementation of the first aspect the predetermined frequency interval lies between 200 Hertz (Hz) and 600 Hz or between 300 Hz and 1.5 kilohertz (kHz). These frequency ranges correspond with the frequency dependent sensitivity of human hearing, in which IPD parameters are most meaningful.

According to a fourth implementation of the first aspect the reference audio channel signal comprises one of the audio channel signals or a downmix audio signal derived from at least two audio channel signals of the plurality of audio channel signals.

According to a fifth implementation of the first aspect calculating the plurality of ICD values comprises calculating the plurality of ICD values on the basis of frequency subbands.

According to a first implementation of the fifth implementation of the first aspect the frequency-dependent weighting factors are determined on the basis of the energy of the frequency subbands normalized on the basis of the overall energy over the predetermined frequency range.

According to a second implementation of the fifth implementation of the first aspect the frequency-dependent weighting factors are determined on the basis of a masking curve for the energy distribution of the frequencies of the audio channel signals normalized over the predetermined frequency range.

According to a third implementation of the fifth implementation of the first aspect the frequency-dependent weighting factors are determined on the basis of perceptual entropy values of the subbands of the audio channel signals normalized over the predetermined frequency range.

According to a sixth implementation of the first aspect the frequency-dependent weighting factors are smoothed between at least two consecutive frames. This may be advantageous since the estimated ICD values are relatively stable between consecutive frames due to the stereo image usually not changing a lot during a short period of time.

According to a second aspect of the present invention, a spatial audio coding device comprises a transformation module configured to apply a transformation from a time domain to a frequency domain to a plurality of audio channel signals, and a parameter estimation module configured to calculate a plurality of ICD values for the ICDs between at least one of the plurality of audio channel signals and a reference audio channel signal over a predetermined frequency range, to calculate, for each of the plurality of ICD values, a weighted ICD value by multiplying each of the plurality of ICD values with a corresponding frequency-dependent weighting factor, and to calculate an ICD range value for the predetermined frequency range by adding the plurality of weighted ICD values.

According to a first implementation of the second aspect, the spatial audio coding device further comprises a downmixing module configured to generate a downmix audio channel signal by downmixing the plurality of audio channel signals.

According to a second implementation of the second aspect, the spatial audio coding device further comprises an encoding module coupled to the downmixing module and configured to generate an encoded audio bitstream comprising the encoded downmixed audio bitstream.

According to a third implementation of the second aspect, the spatial audio coding device further comprises a streaming module coupled to the parameter estimation module and configured to generate an audio bitstream comprising a downmixed audio bitstream and auxiliary data comprising ICD range values for the plurality of audio channel signals.

According to a first implementation of the third implementation of the second aspect the streaming module is further configured to set a flag in the audio bitstream, the flag indicating the presence of auxiliary data comprising the ICD range values in the audio bitstream.

According to a fourth implementation of the second aspect the flag is set for the whole audio bitstream or comprised in the auxiliary data comprised in the audio bitstream.

According to a third aspect of the present invention, a computer program is provided, the computer program comprising a program code for performing the method according to the first aspect or any of its implementations when run on a computer.

The methods described herein may be implemented as software in a Digital Signal Processor (DSP), in a microcontroller or in any other side-processor or as hardware circuit within an application specific integrated circuit (ASIC).

The invention can be implemented in digital electronic circuitry, or in computer hardware, firmware, software, or in combinations thereof.

Additional embodiments and implementations may be readily understood from the following description. In particular, any features from the embodiments, aspects and implementations as set forth hereinbelow may be combined with any other features from the embodiments, aspects and implementations, unless specifically noted otherwise.

BRIEF DESCRIPTION OF DRAWINGS

The accompanying drawings are included to provide a further understanding of the disclosure. They illustrate embodiments and may help to explain the principles of the invention in conjunction with the description. Other embodiments and many of the intended advantages, envisaged principles and functionalities will be appreciated as they become better understood by reference to the detailed description as following hereinbelow. The elements of the drawings are not necessarily drawn to scale relative to each other. In general, like reference numerals designate corresponding similar parts.

DESCRIPTION OF EMBODIMENTS

In the following detailed description, reference is made to the accompanying drawings, and in which, by way of illustration, specific embodiments are shown. It should be obvious that other embodiments may be utilized and structural or logical changes may be made without departing from the scope of the present invention. Unless specifically noted otherwise, functions, principles and details of each embodiment may be combined with other embodiments. Generally, this application is intended to cover any adaptations or variations of the specific embodiments discussed herein. Hence, the following detailed description is not to be taken in a limiting sense, and the scope of the present invention is defined by the appended claims.

Embodiments may include methods and processes that may be embodied within machine readable instructions provided by a machine readable medium, the machine readable medium including, but not being limited to devices, apparatuses, mechanisms or systems being able to store information which may be accessible to a machine such as a computer, a calculating device, a processing unit, a networking device, a portable computer, a microprocessor or the like. The machine readable medium may include volatile or non-volatile media as well as propagated signals of any form such as electrical signals, digital signals, logical signals, optical signals, acoustical signals, acousto-optical signals or the like, the media being capable of conveying information to a machine.

In the following, reference is made to methods and method steps, which are schematically and exemplarily illustrated in flow charts and block diagrams. It should be understood that the methods described in conjunction with those illustrative drawings may easily be performed by embodiments of systems, apparatuses and/or devices as well. In particular, it should be obvious that the systems, apparatuses and/or devices capable of performing the detailed block diagrams and/or flow charts are not necessarily limited to the systems, apparatuses and/or devices shown and detailed herein below, but may rather be different systems, apparatuses and/or devices. The terms "first", "second", "third", etc. are used merely as labels, and are not intended to impose numerical requirements on their objects or to establish a certain ranking of importance of their objects.

Figure 1:
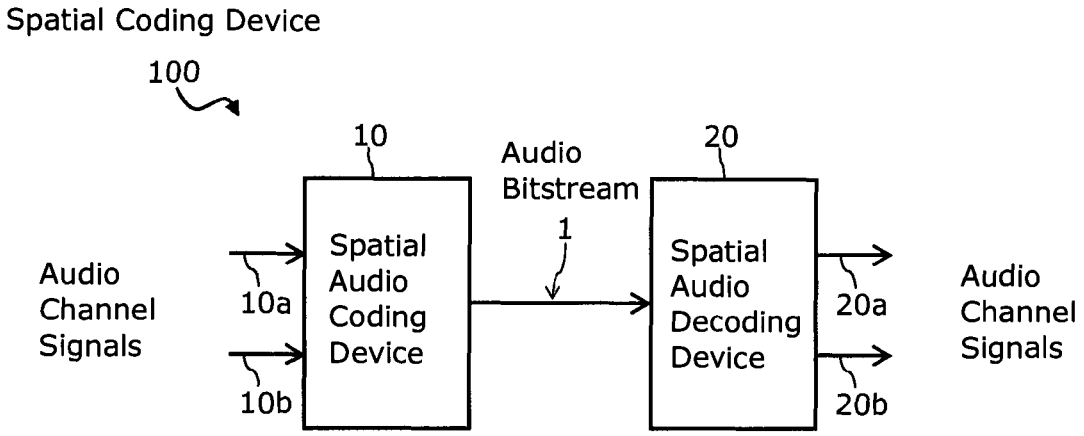
FIG. 1 schematically illustrates a spatial audio coding system.

FIG. 1 schematically illustrates a spatial audio coding system 100. The spatial audio coding system 100 comprises a spatial audio coding device 10 and a spatial audio decoding device 20. A plurality of audio channel signals 10*a*, 10*b*, of which only two are exemplarily shown in FIG. 1, are input to the spatial audio coding device 10. The spatial audio coding device 10 encodes and downmixes the audio channel signals 10*a*, 10*b* and generates an audio bitstream 1 that is transmitted to the spatial audio decoding device 20. The spatial audio decoding device 20 decodes and upmixes the audio data included in the audio bitstream 1 and generates a plurality of output audio channel signals 20*a*, 20*b*, of which only two are exemplarily shown in FIG. 1. The number of audio channel signals 10*a*, 10*b* and 20*a*, 20*b*, respectively, is in principle not limited. For example, the number of audio channel signals 10*a*, 10*b* and 20*a*, 20*b* may be two for binaural stereo signals. For example the binaural stereo signals may be used for three-dimensional (3D) audio or headphone-based surround rendering, for example with head-related transfer function (HRTF) filtering.

The spatial audio coding system 100 may be applied for encoding of the stereo extension of ITU-T G.722, G. 722 Annex B, G.711.1 and/or G.711.1 Annex D. Moreover, the spatial audio coding system 100 may be used for speech and audio coding/decoding in mobile applications, such as defined in Third Generation Partnership (3GPP) Enhanced Voice Services (EVS) codec.

Figure 2:
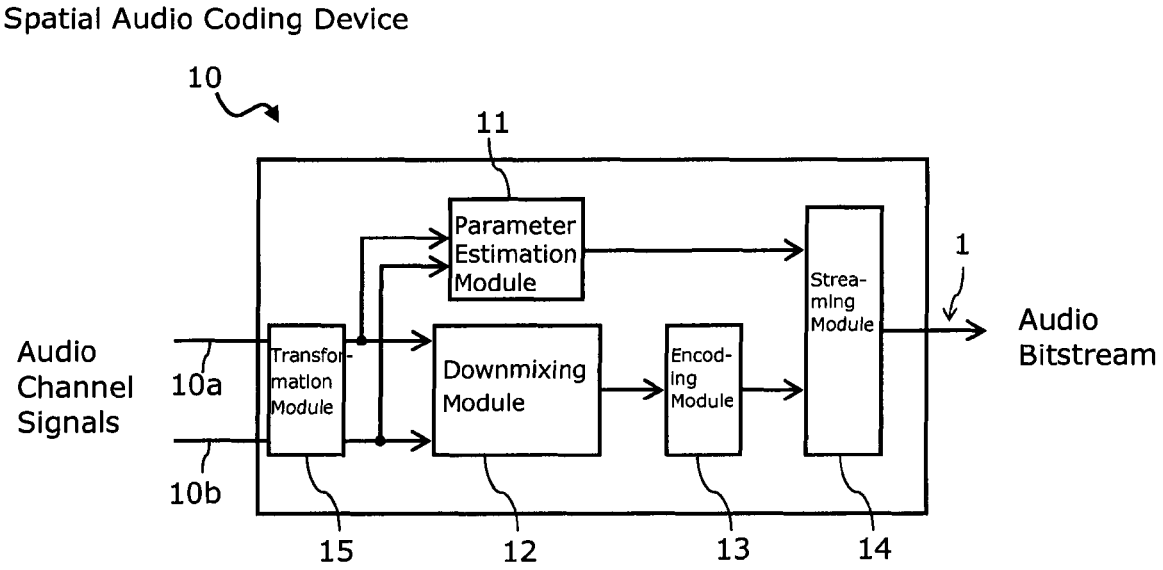
FIG. 2 schematically illustrates a spatial audio coding device.

FIG. 2 schematically shows the spatial audio coding device 10 of FIG. 1 in greater detail. The spatial audio coding device 10 may comprise a transformation module 15, a parameter estimation module 11 coupled to the transformation module 15, a downmixing module 12 coupled to the transformation module 15, an encoding module 13 coupled to the downmixing module 12 and a streaming module 14 coupled to the encoding module 13 and the parameter estimation module 11.

The transformation module 15 may be configured to apply a transformation from a time domain to a frequency domain to a plurality of audio channel signals 10*a*, 10*b* input to the spatial audio coding device 10. The downmixing module 12 may be configured to receive the transformed audio channel signals 10*a*, 10*b* from the transformation module 15 and to generate at least one downmixed audio channel signal by downmixing the plurality of transformed audio channel signals 10*a*, 10*b*. The number of downmixed audio channel signals may for example be less than the number of transformed audio channel signals 10*a*, 10*b*. For example, the downmixing module 12 may be configured to generate only one downmixed audio channel signal. The encoding module 13 may be configured to receive the downmixed audio channel signals and to generate an encoded audio bitstream 1 comprising the encoded downmixed audio channel signals.

The parameter estimation module 11 may be configured to receive the plurality of audio channel signals 10*a*, 10*b* as input and to calculate a plurality of ICD values for the ICDs between at least one of the plurality of audio channel signals 10*a* and 10*b* and a reference audio channel signal over a predetermined frequency range. The reference audio channel signal may for example be one of the plurality of audio channel signals 10*a* and 10*b*. Alternatively, it may be possible to use a downmixed audio signal derived from at least two audio channel signals of the plurality of audio channel signals 10*a* and 10*b*. The parameter estimation module 11 may further be configured to calculate, for each of the plurality of ICD values, a weighted ICD value by multiplying each of the plurality of ICD values with a corresponding frequency-dependent weighting factor, and to calculate an ICD range value for the predetermined frequency range by adding the plurality of weighted ICD values.

The ICD range value may then be input to the streaming module 14 which may be configured to generate the output audio bitstream 1 comprising the encoded audio bitstream from the encoding module 13 and a parameter section comprising a quantized representation of the ICD range value. The streaming module 14 may further be configured to set a parameter type flag in the parameter section of the audio bitstream 1 indicating the type of ICD range value being included into the audio bitstream 1.

Additionally, the streaming module 14 may further be configured to set a flag in the audio bitstream 1, the flag indicating the presence of the ICD range value in the parameter section of the audio bitstream 1. This flag may be set for the whole audio bitstream 1 or comprised in the parameter section of the audio bitstream 1. That way, the signalling of the ICD range value being included into the audio bitstream 1 may be signalled explicitly or implicitly to the spatial audio decoding device 20. It may be possible to switch between the explicit and implicit signalling schemes.

In the case of implicit signalling, the flag may indicate the presence of the secondary channel information in the auxiliary data in the parameter section. A legacy spatial audio decoding device 20 does not check whether such a flag is present and thus only decodes the encoded downmixed audio bitstream 1. On the other hand, a non-legacy, i.e. up-to-date spatial audio decoding device 20 may check the presence of such a flag in the received audio bitstream 1 and reconstruct the multi-channel audio signal 20*a*, 20*b* based on the additional full band spatial coding parameters, i.e. the ICD range value included in the parameter section of the audio bitstream 1.

When using explicit signalling, the whole audio bitstream 1 may be flagged as containing an ICD range value. That way, a legacy spatial audio decoding device 20 is not able to decode the bitstream and thus discards the audio bitstream 1. On the other hand, an up-to-date spatial audio decoding device 20 may decide on whether to decode the audio bitstream 1 as a whole or only to decode the encoded downmixed audio bitstream 1 while neglecting the ICD range value. The benefit of the explicit signalling may be seen in that, for example, a new mobile terminal can decide what parts of an audio bitstream 1 to decode in order to save energy and thus extend the battery life of an integrated battery. Decoding spatial coding parameters is usually more complex and requires more energy. Additionally, depending on the rendering system, the up-to-date spatial audio decoding device 20 may decide which part of the audio bitstream 1 should be decoded. For example, for rendering with headphones it may be sufficient to only decode the encoded downmixed audio bitstream 1, while the multi-channel audio signal is decoded only when the mobile terminal is connected to a docking station with such multi-channel rendering capability.

Figure 3:
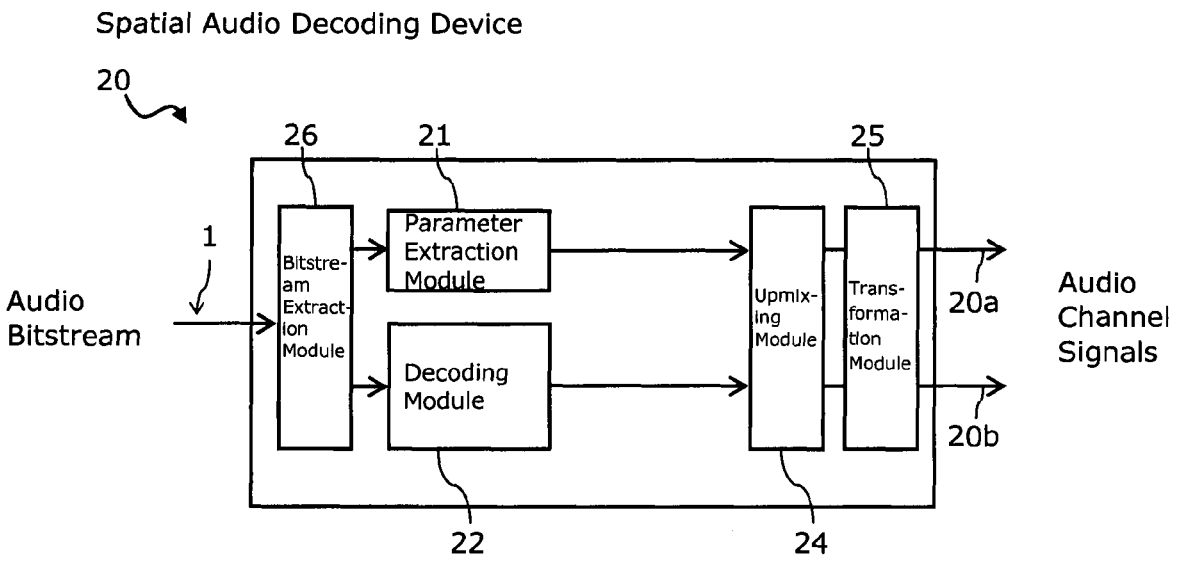
FIG. 3 schematically illustrates a spatial audio decoding device.

FIG. 3 schematically shows the spatial audio decoding device 20 of FIG. 1 in greater detail. The spatial audio decoding device 20 may comprise a bitstream extraction module 26, a parameter extraction module 21, a decoding module 22, an upmixing module 24 and a transformation module 25. The bitstream extraction module 26 may be configured to receive an audio bitstream 1 and separate the parameter section and the encoded downmixed audio bitstream 1 enclosed in the audio bitstream 1. The parameter extraction module 21 may be configured to detect a parameter type flag in the parameter section of a received audio bitstream 1 indicating an ICD range value being included into the audio bitstream 1. The parameter extraction module 21 may further be configured to read the ICD range value from the parameter section of the received audio bitstream 1.

The decoding module 22 may be configured to decode the encoded downmixed audio bitstream 1 and to input the decoded downmixed audio signal into the upmixing module 24. The upmixing module 24 may be coupled to the parameter extraction module 21 and configured to upmix the decoded downmixed audio signal to a plurality of audio channel signals using the read ICD range value from the parameter section of the received audio bitstream 1 as provided by the parameter extraction module 21. Finally, the transformation module 25 may be coupled to the upmixing module 24 and configured to transform the plurality of audio channel signals from a frequency domain to a time domain for reproduction of sound on the basis of the plurality of audio channel signals.

Figure 4:
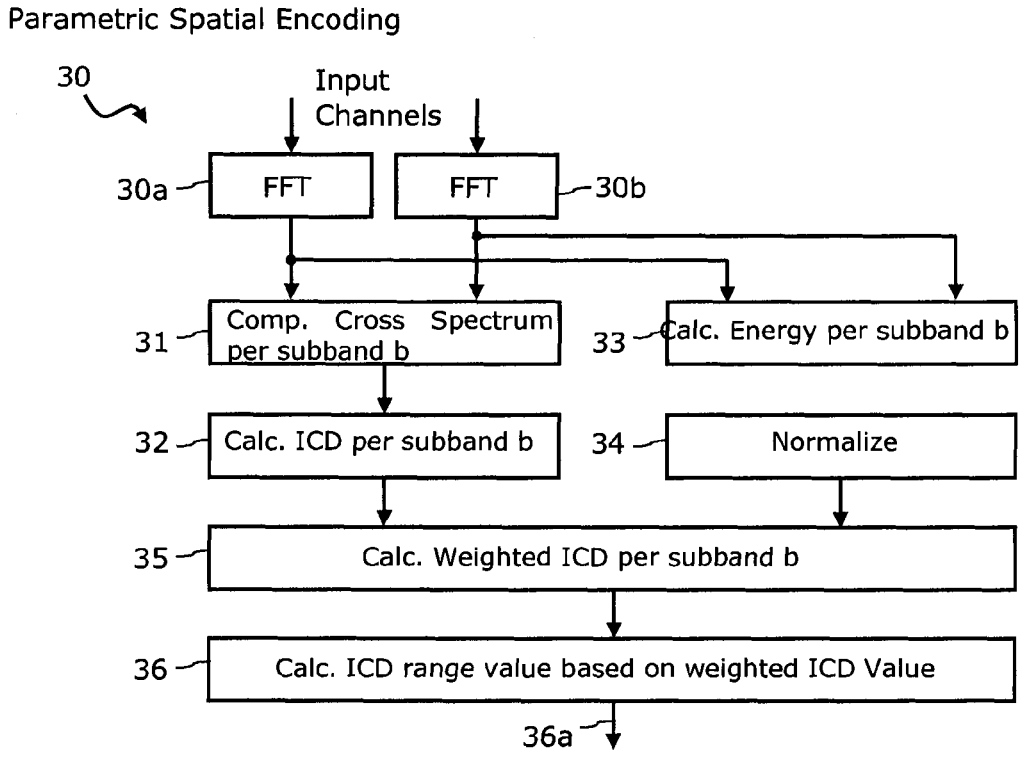
FIG. 4 schematically illustrates an embodiment of a method for the estimation of ICDs.

FIG. 4 schematically shows an embodiment of a method 30 for parametric spatial encoding. The method 30 comprises in a first step performing a time-frequency transformation on input channels, for example the input channels 10*a*, 10*b*. In case of a stereo signal, a first transformation is performed at step 30*a* and a second transformation is performed at step 30*b*. The transformation may in each case be performed using Fast Fourier transformation (FFT). Alternatively, Short Term Fourier Transformation (STFT), cosine modulated filtering with a cosine modulated filter bank or complex filtering with a complex filter bank may be performed.

In a second step 31, a cross spectrum c[b] may be computed per subband b as $$c[b]=\Sigma_{k=k_b}^{k_{b+1}-1}X_1[k]\cdot X_2[k]^*,$$

wherein X1[k] and X2[k] are the FFT coefficients of the two channels 1 and 2, for example the left and the right channel in case of stereo. "*" denotes the complex conjugation, kb denotes the start bin of the subband b and kb+1 denotes the start bin of the neighbouring subband b+1. Hence, the frequency bins [k] of the FFT from kb to kb+1 represent the subband b.

Alternatively, the cross spectrum may be computed for each frequency bin k of the FFT. In this case, the subband b corresponds directly to one frequency bin [k].

In a third step 32, ICDs may be calculated per subband b based on the cross spectrum. For example, in case of the IPD such calculation may be conducted as $$\mathrm{IPD}[b]=\angle c[b]$$

wherein the IPD per subband b is the angle of the cross spectrum c[b] of the respective subband b. The steps 31 and 32 ensure that a plurality of ICD values, in particular IPD values, for the ICDs/IPDs between at least one of the plurality of audio channel signals and a reference audio channel signal over a predetermined frequency range are calculated. Moreover, each ICD value is calculated over a portion of the predetermined frequency range, which is a frequency subband b or at least a single frequency bin.

The calculation scheme as detailed with respect to steps 31 and 32 corresponds to the method as known from Breebart, J., van de Par, S., Kohlrausch, A., Schuijers, E.: "Parametric Coding of Stereo Audio", EURASIP Journal on Applied Signal Processing, 2005, No. 9, pp. 1305-1322.

This IPD value represents a phase difference for a band limited signal. If the bandwidth is limited enough, this phase difference can be seen as fractional delay between the input signals. For each frequency subband b, IPD and ITDs represent the same information. But for the full bank, the IPD value differs from the ITD value: Full band IPD is the constant phase difference between two channels 1 and 2, whereas full band ITD is the constant time difference between two channels.

In order to calculate the full band IPD on the basis of the subband IPD values, it might be possible to compute the average over all subband IPD values to obtain the full band IPD value, i.e. the IPD range value over the full frequency range of the audio channel signals. However, this estimation method may lead to a wrong estimation of a representative IPD range value, since the frequency subbands have differing perceptual importance.

For computation of an ICD range value a predetermined frequency range may be defined. For example, the predetermined frequency range may be the full frequency band of the plurality of audio channel signals. Alternatively, one or more predetermined frequency interval within the full frequency band of the plurality of audio channel signals may be chosen, which predetermined frequency intervals may be coherent or spaced apart. The predetermined frequency range may for example include the frequency band between 200 Hz and 600 Hz or alternatively between 300 Hz and 1.5 kHz.

In a third step 33 and a fourth step 34, parallel to the first and second steps 31 and 32, the energy E[b] of each portion of the predetermined frequency range, i.e. each frequency subband b or frequency bin b is calculated by $$E[b]=(X_1[k]^2+X_2[b]^2),$$

or alternatively $$E[b]=\Sigma_{k=k_b}^{k_{b+1}-1}(X_1[k]^2+X_2[k]^2),$$

and subsequently normalized over the energy envelope group (EG) of the predetermined frequency range, for example the full band:

$$E_G=\Sigma_{b=M_{min}}^{M_{max}}E[b],$$

wherein Mmin and Mmax are the index of the lowest and highest frequency subband or bin within the predetermined frequency range, respectively.

In step 35, for each of the plurality of ICD values, for example the values IPD[b], a weighted ICD value, for example a weighted IPD value IPDw[b], is calculated by multiplying each of the plurality of ICD values with a corresponding frequency-dependent weighting factor Ew[b]:

$$\mathrm{IPD}_w[b]=IPD[b]\cdot E_w[b].$$

The frequency-dependent weighting factor may for example be an associated weighted energy value Ew[b] as computed by $$E_w[b]=E[b]/E_G.$$

It may be possible to smooth the weighting factors Ew[b] over consecutive frames, i.e. taking into account a fraction of the weighting factors Ew[b] of previous frames of the plurality of audio channel signals when calculating the current weighting factors Ew[b].

Finally, in a step 36, an ICD range value, for example a full band IPD value IPDF may be calculated for the predetermined frequency range by adding the plurality of weighted ICD values:

$$\mathrm{IPD}_F=\Sigma_{b=M_{min}}^{M_{max}} IPD_w[b].$$

Alternatively, the weighting factors Ew[b] may be derived from a masking curve for the energy distribution of the frequencies of the audio channel signals normalized over the predetermined frequency range. Such a masking curve may for example be computed as known from Bosi, M., Goldberg, R.: "Introduction to Digital Audio Coding and Standards", Kluwer Academic Publishers, 2003. It is also possible to determine the frequency-dependent weighting factors on the basis of perceptual entropy values of the subbands b of the audio channel signals normalized over the predetermined frequency range. In that case, the normalized version of the masking curve or the perceptual entropy may be used as weighting function.

The method as shown in FIG. 4 may also be applied to multi-channel parametric audio coding. A cross spectrum may be computed per subband b and per each channel j as $$c_j[b]=\Sigma_{k=k_b}^{k_{b+1}-1} X_j[k]\cdot X_{ref}[k]^*,$$

wherein Xj[k] is the FFT coefficient of the channel j and Xref[k] is the FFT coefficient of a reference channel. The reference channel may be a select one of the plurality of channels j. Alternatively, the reference channel may be the spectrum of a mono downmix signal, which is the average over all channels j. In the former case, M−1 spatial cues are generated, whereas in the latter case, M spatial cues are generated, with M being the number of channels j. "*" denotes the complex conjugation, kb denotes the start bin of the subband b and kb+1 denotes the start bin of the neighbouring subband b+1. Hence, the frequency bins [k] of the FFT from kb to kb+1 represent the subband b.

Alternatively, the cross spectrum may be computed for each frequency bin k of the FFT. In this case, the subband b corresponds directly to one frequency bin [k].

The ICDs of channel j may be calculated per subband b based on the cross spectrum. For example, in case of the IPD such calculation may be conducted as $$\mathrm{IPD}_j[b]=\angle c_j[b],$$

wherein the IPDj per subband b and channel j is the angle of the cross spectrum cj[b] of the respective subband b and channel j.

The energy Ej[b] per channel j of each portion of the predetermined frequency range, i.e. each frequency subband b or frequency bin b is calculated by $$E_j[b]=2\cdot X_j[b]\cdot X_{ref}[b]$$

or alternatively $$E[b]=\Sigma_{k=k_b}^{k_{b+1}-1}(X_j[k]^2+X_{ref}[k]^2),$$

and subsequently normalized over the energy EGj of the predetermined frequency range, for example the full band:

$$E_{Gj}=\Sigma_{b=M_{min}}^{M_{max}} E_j[b],$$

wherein Mmin and Mmax are the index of the lowest and highest frequency subband or bin within the predetermined frequency range, respectively.

For each of the plurality of ICD values, for example the values IPDj[b], a weighted ICD value, for example a weighted IPD value IPDwj[b], is calculated by multiplying each of the plurality of ICD values with a corresponding frequency-dependent weighting factor Ewj[b]:

$$\mathrm{IPD}_{wj}[b]=IPD_j[b]\cdot E_{wj}[b].$$

The frequency-dependent weighting factor may for example be an associated weighted energy value Ewj[b] as computed by $$E_{wj}[b]=E_j[b]/E_{Gj}.$$

It may be possible to smooth the weighting factors Ewj[b] over consecutive frames, i.e. taking into account a fraction of the weighting factors Ewj[b] of previous frames of the plurality of audio channel signals when calculating the current weighting factors Ewj[b].

Finally, an ICD range value, for example a full band IPD value IPDFj may be calculated for the predetermined frequency range by adding the plurality of weighted ICD values:

$$\mathrm{IPD}_{Fj}=\Sigma_{b=M_{min}}^{M_{max}} IPD_{wj}[b].$$

Figure 5:
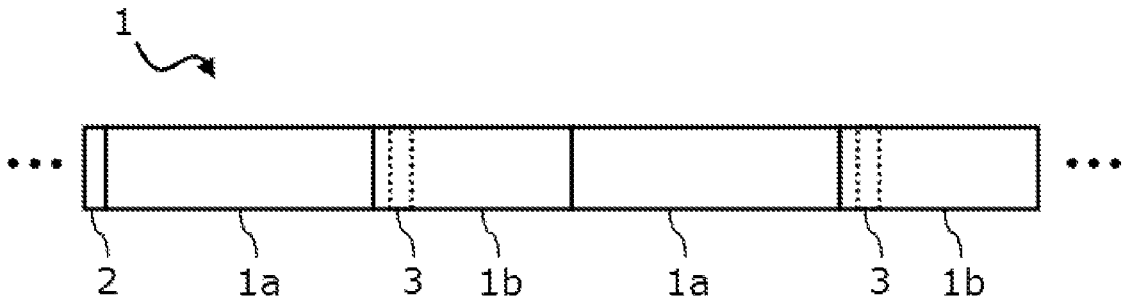
FIG. 5 schematically illustrates a variant of a bitstream structure for an audio bitstream.

FIG. 5 schematically illustrates a bitstream structure of an audio bitstream, for example the audio bitstream 1 detailed in FIGS. 1 to 3. In FIG. 5 the audio bitstream 1 may include an encoded downmixed audio bitstream section 1*a* and a parameter section 1*b*. The encoded downmixed audio bitstream section 1*a* and the parameter section 1*b* may alternate and their combined length may be indicative of the overall bitrate of the audio bitstream 1. The encoded downmixed audio bitstream section 1*a* may include the actual audio data to be decoded. The parameter section 1*b* may comprise one or more quantized representations of spatial coding parameters such as the ICD range value. The audio bitstream 1 may for example include a signalling flag bit 2 used for explicit signalling whether the audio bitstream 1 includes auxiliary data in the parameter section 1*b* or not. Furthermore, the parameter section 1*b* may include a signalling flag bit 3 used for implicit signalling whether the audio bitstream 1 includes auxiliary data in the parameter section 1*b* or not.

What is claimed is:

1. A method for estimating inter-channel differences (ICDs), comprising:

applying a transformation from a time domain to a frequency domain to a plurality of audio channel signals;

calculating a plurality of ICD values for the ICDs between at least one of the plurality of audio channel signals and a reference audio channel signal over a predetermined frequency range, each ICD value being calculated over a portion of the predetermined frequency range;

calculating, for each of the plurality of ICD values, a weighted ICD value by multiplying each of the plurality of ICD values with a corresponding frequency-dependent weighting factor; and calculating an ICD range value for the predetermined frequency range by adding the plurality of weighted ICD values.

2. The method of claim 1, wherein the ICDS are inter-channel phase differences (IPDs) or inter-channel time differences (ITDs).

3. The method of claim 1, wherein transformation from the time domain to the frequency domain comprises a Fast Fourier Transformation (FFT) or a Discrete Fourier Transformation (DFT).

4. The method of claim 1, wherein the predetermined frequency range comprises one of the group of a full frequency band of the plurality of audio channel signals, a predetermined frequency interval within the full frequency band of the plurality of audio channel signals, and a plurality of predetermined frequency intervals within the full frequency band of the plurality of audio channel signals.

5. The method of claim 4, wherein the predetermined frequency interval lies between 200 Hertz (Hz) and 600 Hz.

6. The method of claim 4, wherein the predetermined frequency interval lies between 300 Hertz (Hz) and 1.5 kilohertz (kHz).

7. The method of claim 1, wherein the reference audio channel signal comprises one of the audio channel signals or a downmixed audio signal derived from at least two audio channel signals of the plurality of audio channel signals.

8. The method of claim 1, wherein calculating the plurality ICD values comprises calculating the plurality of ICD values on the basis of frequency subbands.

9. The method of claim 8, wherein the frequency-dependent weighting factors are determined on the basis of the energy of the frequency subbands normalized on the basis of the overall energy over the predetermined frequency range.

10. The method of claim 8, wherein the frequency-dependent weighting factors are determined on the basis of a masking curve for the energy distribution of the frequencies of the audio channel signals normalized over the predetermined frequency range.

11. The method of claim 8, wherein the frequency-dependent weighting factors are determined on the basis of perceptual entropy values of the subbands of the audio channel signals normalized over the predetermined frequency range.

12. The method of claim 1, wherein the frequency-dependent weighting factors are smoothed between at least two consecutive frames.

13. The method of claim 1, wherein the ICDs are interchannel time differences (ITDs).

14. The method of claim 1, wherein transformation from the time domain to the frequency domain comprises a cosine modulated filter bank or a complex filter bank.

15. A spatial audio coding device, comprising:

a transformation module configured to apply a transformation from a time domain to a frequency domain to a plurality of audio channel signals; and a parameter estimation module configured to calculate a plurality of inter-channel difference (ICD) values for the ICDs between at least one of the plurality of audio channel signals and a reference audio channel signal over a predetermined frequency range, to calculate, for each of the plurality of ICD values, a weighted ICD value by multiplying each of the plurality of ICD values with a corresponding frequency-dependent weighting factor, and to calculate ICD range value for the predetermined frequency range by adding the plurality of weighted ICD values.

16. The spatial audio coding device of claim 15, further comprising a downmixing module configured to generate a downmixed audio channel signal by downmixing the plurality of audio channel data signals.

17. The spatial audio coding device of claim 16, further comprising an encoding module coupled to the downmixing module and configured to generate an encoded audio bitstream comprising the encoded downmixed audio bitstream.

18. The spatial audio coding device of claim 15, further comprising a streaming module coupled to the parameter estimation module and configured to generate an audio bitstream comprising a downmixed audio bitstream and auxiliary data comprising the ICD range values for the plurality of audio channel signals.

19. An apparatus for estimating inter-channel phase differences (IPD), comprising:

at least one processor configured to:

apply a transformation from a time domain to a frequency domain to a plurality of audio channel signals;

calculate a plurality of IPD values for the IPDs between at least one of the plurality of audio channel signals and a reference audio channel signal over a predetermined frequency range, each IPD value being calculated over a portion of the predetermined frequency range;

calculate, for each of the plurality of IPD values, a weighted IPD value by multiplying each of the plurality of IPD values with a corresponding frequency-dependent weighting factor; and calculate an IPD range value for the predetermined frequency range by adding the plurality of weighted IPD values.

* * * * *